US007414187B2

(12) United States Patent
Park et al.

(10) Patent No.: US 7,414,187 B2
(45) Date of Patent: Aug. 19, 2008

(54) APPARATUS AND METHOD FOR SYNTHESIZING MIDI BASED ON WAVE TABLE

(75) Inventors: Yong Chul Park, Seoul (KR); Jung Min Song, Seoul (KR); Jae Hyuck Lee, Seoul (KR); Jun Yup Lee, Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 472 days.

(21) Appl. No.: 11/070,581

(22) Filed: Mar. 1, 2005

(65) Prior Publication Data

US 2005/0211076 A1 Sep. 29, 2005

(30) Foreign Application Priority Data

Mar. 2, 2004 (KR) ..... 10-2004-0013938

(51) Int. Cl.
*G10H 7/00* (2006.01)

(52) U.S. Cl. ..... 84/645; 84/603; 84/609; 84/622

(58) Field of Classification Search ..... 84/645, 84/622, 601–607
See application file for complete search history.

(56) References Cited

U.S. PATENT DOCUMENTS 5,530,661 A * 6/1996 Garbe et al. ..... 708/420
5,668,338 A * 9/1997 Hewitt et al. ..... 84/629
5,680,512 A * 10/1997 Rabowsky et al. ..... 704/504
5,734,119 A * 3/1998 France et al. ..... 84/622
5,744,739 A * 4/1998 Jenkins ..... 84/603
5,835,944 A * 11/1998 Lahti et al. ..... 711/118
5,872,727 A * 2/1999 Kuo ..... 708/313
5,917,917 A * 6/1999 Jenkins et al. ..... 381/63
6,008,446 A * 12/1999 Van Buskirk et al. ..... 84/603
6,088,484 A * 7/2000 Mead ..... 382/232
6,096,960 A * 8/2000 Scott ..... 84/603
6,138,224 A * 10/2000 Lisle ..... 711/206
6,157,976 A * 12/2000 Tien et al. ..... 710/314
6,195,736 B1 * 2/2001 Lisle ..... 711/206
6,266,753 B1 * 7/2001 Hicok et al. ..... 711/202
6,605,769 B1 * 8/2003 Juszkiewicz ..... 84/609
6,606,689 B1 * 8/2003 Cheng et al. ..... 711/137
6,683,993 B1 * 1/2004 Mead ..... 382/253
7,211,721 B2 * 5/2007 Boillot et al. ..... 84/622
2002/0043151 A1 * 4/2002 Hikawa ..... 84/609
2002/0066359 A1 * 6/2002 Kawashima ..... 84/622
2002/0105359 A1 * 8/2002 Shimizu et al. ..... 327/1
2003/0056636 A1 * 3/2003 Fukuda ..... 84/602

(Continued)

FOREIGN PATENT DOCUMENTS

EP 1 318 501 A 6/2003

(Continued)

*Primary Examiner*—Lincoln Donovan
*Assistant Examiner*—Christina Russell
(74) *Attorney, Agent, or Firm*—Lee, Hong, Degerman, Kang & Schmadeka

(57) ABSTRACT

An apparatus and a method for synthesizing a MIDI based on a wave table are provided. According to the method, sound samples of a plurality of instruments stored in a wave table are compressed and stored so as to reduce the storage space required by the wave table. Bit streams for the samples are decoded to synthesize a MIDI when a specific instrument's sound samples are requested.

20 Claims, 2 Drawing Sheets

U.S. PATENT DOCUMENTS

2004/0083094 A1* 4/2004 Zelazo et al. ..... 704/212
2005/0114136 A1* 5/2005 Hamalainen et al. ..... 704/258
2005/0188819 A1* 9/2005 Lin et al. ..... 84/603
2006/0075880 A1* 4/2006 Boillot et al. ..... 84/604
2006/0272487 A1* 12/2006 Lechner ..... 84/645
2007/0209498 A1* 9/2007 Lindgren et al. ..... 84/609

FOREIGN PATENT DOCUMENTS

JP 2003-233379 8/2003

* cited by examiner

APPARATUS AND METHOD FOR SYNTHESIZING MIDI BASED ON WAVE TABLE

CROSS-REFERENCE TO RELATED APPLICATIONS

Pursuant to 35 U.S.C. § 119(a), this application claims the benefit of earlier filing date and right of priority to Korean Application No. 13938/2004, filed on Mar. 2, 2004, the contents of which is hereby incorporated by reference herein in its entirety.

BACKGROUND OF THE INVENTION

1. Field of the Invention

The present invention relates to an apparatus and a method for synthesizing a musical instrument digital interface (MIDI), and more particularly, to an apparatus and a method for synthesizing a MIDI that is based on a wave table and is capable of compressing and storing sound samples of one or more instruments in the wave table.

2. Description of the Related Art

A MIDI is a standard protocol for data communication between electronic musical instruments. The MIDI is a standard specification for hardware and data structures that provide compatibility between inputs and outputs of musical instruments or between musical instruments and computers through a digital interface. Accordingly, devices having the MIDI can share information because the data created are compatible.

The MIDI contains information regarding how instrument sounds should be expressed as well as basic musical information such as the type of instruments producing sounds, a tone level, and a tone length.

Methods for synthesizing a real sound using a multimedia device on the basis of musical information are roughly divided into a frequency modulation (FM) type method and a wave table type method.

The FM type method extracts frequency information related to a sound that a specific musical instrument should produce and generates signals for the frequency when synthesizing a sound. However, the FM type method is limited to generating certain sounds and the generated sound is quite different from the real sound.

To overcome these disadvantages, a method for recording a real sound and using the recorded sound as a sound source has been developed; wave table type method. The wave table type method obtains and stores samples of sounds actually played for each musical instrument in advance and processes a specific instrument's stored sound samples according to musical information included in a MIDI file in order to synthesize a sound.

Processing stored sound samples according to the musical information contained in the MIDI file to synthesize a sound is generally referred to as MIDI synthesis. Therefore, processing stored sound samples according to the musical information contained in a MIDI file stored in a wave table in order to synthesize a sound is referred to as MIDI synthesis based on a wave table.

When synthesizing a MIDI using the wave table type method, samples of a sound actually played for each instrument are used. Therefore, a tone level is modulated, a tone length is changed, and a tone expression is applied on the basis of musical information described in the MIDI file, thereby producing a sound.

When an instrument's sound samples are obtained and stored in the wave table, articulation data such as variations of the sample sounds in time and fine variations of a frequency are additionally stored. When a sound is synthesized, the articulation data is utilized so that a sound is properly produced.

The wave table used in MIDI synthesis has a predetermined type so as to maintain compatibility between many synthesis apparatus. A downloadable sound (DLS) type is generally used.

A wave table storage format of the DLS type prescribes in what form information of an instrument's sound samples and articulation data are stored. Specifically, the wave table storage format of the DLS type prescribes that an instrument's sound samples are stored in a wave format, which is an audio-data-storing format.

As described above, the conventional wave table type MIDI synthesis method requires that an instrument's sound samples actually be played, thereby requiring a large storage space. The wave table type method requires fewer operations than the FM type synthesis method but requires more storage space in synthesizing a sound. Therefore, it is difficult to perform a MIDI synthesis in a small apparatus having limited storage space.

There is a need for a MIDI synthesis operation and method that is adaptable to a small apparatus leaving limited storage space. The present invention addresses these and other needs.

SUMMARY OF THE INVENTION

The present invention is directed to an apparatus and method for synthesizing a MIDI that is based on a wave table containing compressed sound samples of one or more instruments.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the present invention, as embodied and broadly described, the present invention is embodied in an apparatus and a method for synthesizing a high quality MIDI with a limited storage space by compressing instrument sound sample data stored in a wave table used by a wave table type method. Specifically, uncompressed sound samples for one or more instruments in a wave table are compressed and stored in the wave table, thereby replacing the uncompressed sound samples, and encoded sound samples corresponding to a specific instrument are retrieved, decoded and synthesized in order to generate a sound.

In one aspect of the present invention, an apparatus for synthesizing a MIDI is provided. The apparatus includes a wave table adapted to store both uncompressed sound samples and compressed sound samples and additional information related to the compressed sound samples, a first parser adapted to extract a portion of the uncompressed sound samples corresponding to a specific instrument from the wave table, and an encoder adapted to compress the extracted portion of the uncompressed sound samples to generate the compressed sound samples and the additional information.

Preferably, the encoder compresses the extracted portion of the uncompressed sound samples using one of a plurality of formats and the wave table stores sound samples compressed using the plurality of formats. It is contemplated that the encoder may selectively encode the extracted portion of the uncompressed sound samples using an encoding method corresponding to the characteristics of sound samples from the specific instrument. It is further contemplated that the encoder may encode the extracted portion of the uncompressed sound samples using an encoding method that obtains high quality with a small data rate and great encoding complexity.

Preferably, the compressed sound samples and additional information generated by the encoder for each of a plurality of instruments are substituted for the corresponding uncompressed sound samples in the wave table such that the wave table contains only compressed information. It is contemplated that the additional information may include coding parameters, sample length, and/or an indication of a compression format used.

It is contemplated that the apparatus may also include a second parser adapted to extract a portion of the compressed sound samples and additional information corresponding to a requested instrument from the wave table, a decoder adapted to decode the extracted portion of the compressed sound samples to generate decoded sound samples, and a MIDI synthesizer adapted to perform a MIDI synthesis using the decoded sound samples. Preferably, the second parser separates the additional information from the extracted portion of the compressed sound samples and the decoder utilizes the additional information to decode the extracted portion of the compressed sound samples.

In another aspect of the present invention, a method for synthesizing a MIDI is provided. The method includes compressing and storing sound samples for one or more instruments in a wave table such that the size of the wave table is reduced and decoding the stored compressed sound samples to synthesize a MIDI for a requested instrument.

Preferably, the sound samples are compressed and stored by extracting a portion of uncompressed sound samples corresponding to a specific instrument from the wave table, compressing the extracted portion of the uncompressed sound samples to generate compressed sound samples and additional information related to the compressed sound samples, and storing the compressed sound samples and additional information in the wave table such that the compressed sound samples and additional information replace the extracted portion of uncompressed sound samples. An encoded wave table may be generated by extracting uncompressed sound samples corresponding to each of a plurality of instruments from the wave table, compressing the extracted uncompressed sound samples to generate compressed sound samples and additional information corresponding to each of a plurality of instruments, and replacing the uncompressed sound samples corresponding to each of a plurality of instruments with the corresponding compressed sound samples and additional information. It is contemplated that extracting, compressing and replacing the sound samples corresponding to each of a plurality of instruments may not be real-time processes and may performed to generate the encoded wave table prior to decoding any stored compressed sound samples to synthesize the MIDI.

It is contemplated that the extracted portion of the uncompressed sound samples may be compressed using one of a plurality of formats. It is further contemplated that compressing the extracted portion of the uncompressed sound samples may be performed using an encoding method that obtains high quality with a small data rate and great encoding complexity. Preferably, the extracted portion of the uncompressed sound samples are compressed by selectively performing an encoding method corresponding to the characteristics of sound samples from the specific instrument.

Preferably, the stored compressed sound samples are decoded by extracting a portion of the compressed sound samples and additional information corresponding to a requested instrument from the wave table, separating the additional information from the extracted portion of the compressed sound samples, decoding the extracted portion of the compressed sound samples using the additional information to generate decoded sound samples, and synthesizing the MIDI using the decoded sound samples. It is contemplated that the additional information may include coding parameters, sample length, and/or an indication of a compression format used.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENTS

The present invention is directed to an apparatus and method for synthesizing a MIDI that is based on a wave table containing compressed sound samples of one or more instruments. Although the present invention is illustrated with respect to a MIDI, it is contemplated that the present invention may be utilized anytime it is desired to compress sound samples for reproduction.

Figure 1:
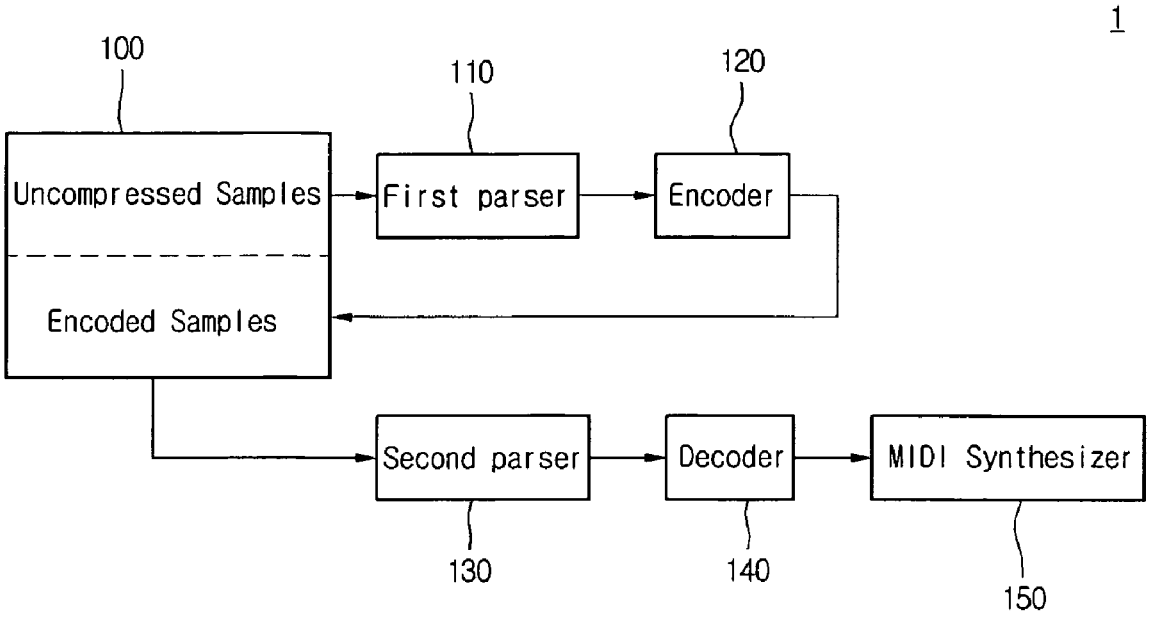
FIG. 1 is a schematic block diagram of an apparatus for synthesizing a MIDI based on a wave table according to one embodiment of the present invention.

Referring to FIG. 1, an apparatus 1 for synthesizing a MIDI according to one embodiment of the preset invention includes a wave table 100 for storing an instrument's sound samples and additional information in various formats, a first parser 110 for extracting a portion of an instrument's stored uncompressed sound samples from the wave table, an encoder 120 for compressing the extracted portion of the instrument's uncompressed sound samples, a second parser 130 for extracting a portion of an instrument's compressed sound samples from the wave table, a decoder 140 for decoding the extracted portion of the instrument's compressed sound samples, and a MIDI synthesizer 150 for performing a MIDI synthesis using the instrument's decoded sound samples.

The wave table 100 includes an instrument's uncompressed sound samples. Encoded bit streams generated by passing the instrument's uncompressed sound samples through the first parser 110 and the encoder 120 are stored in the wave table by replacing the instrument's uncompressed sound samples such that the wave table is converted into an encoded wave table as compressed sound samples replace uncompressed sound samples.

The process of establishing the encoded wave table includes storing the bit streams generated by the encoding process in the wave table 100. The conventional art wave table contains an instrument's uncompressed sound samples. The process of establishing the encoded wave table according to the present invention includes storing the encoded bit streams in the wave table by replacing the original uncompressed sound samples.

The first parser 110 extracts a portion of the wave table 100 containing a specific instrument's uncompressed sound samples such that only data of the specific instrument's sound samples is extracted.

The encoder 120 performs an encoding process. During the encoding process, the extracted samples of the specific instrument are compressed using an audio compression method. Various conventional audio compression methods may be used. Preferably, an encoding method appropriate for the specific instrument's characteristics is selectively used. Since the encoding process does not require real-time processing, an encoding method for obtaining high quality with a small data rate and great encoding complexity may be used.

After the wave table 100 is converted into the encoded wave table, a MIDI synthesis may be performed using the encoded sound samples of a specific instrument. A portion of the encoded wave table 100 containing the specific instrument's encoded sound samples is extracted by the second parser 130 and bit streams containing the specific instrument's encoded sound samples are produced. Additional information, such as coding parameters, is separated from the extracted bit streams. Next, the decoder 140 decodes the encoded samples using the additional information and the MIDI synthesizer 150 performs a MIDI synthesis using the decoded sound samples.

A method for synthesizing a MIDI according to one embodiment of the present invention encodes and stores an instrument's sound samples in the wave table and decodes the compressed bit streams for use in synthesizing a sound of the instrument. The method uses an encoded wave table and includes generating an encoded wave table and synthesizing a MIDI by decoding an instrument's encoded sound samples.

Figure 2:
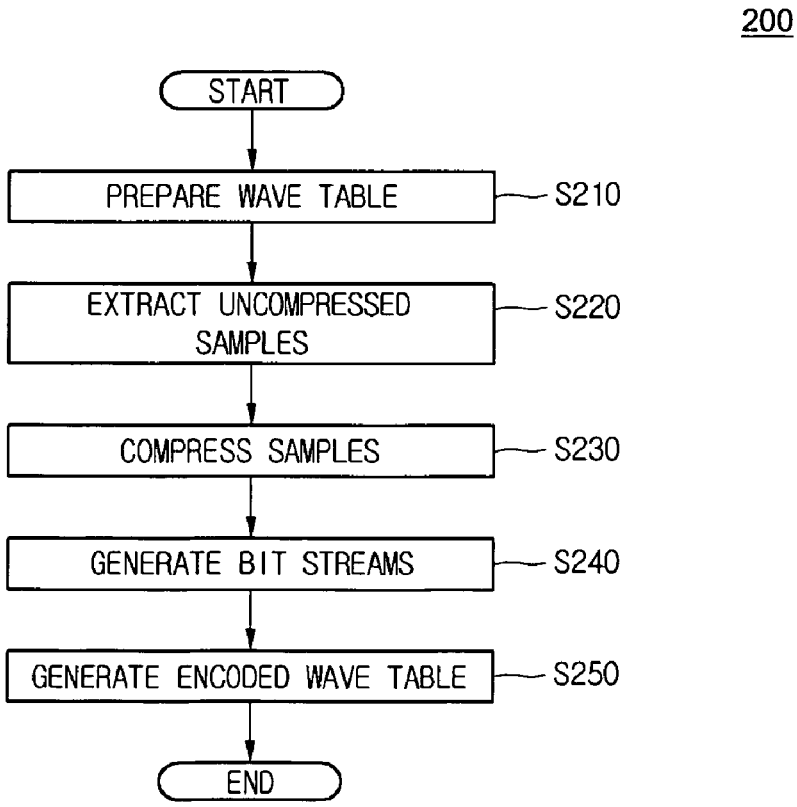
FIG. 2 is a flowchart illustrating a method for synthesizing an encoded wave table for a MIDI synthesis method based on a wave table according to one embodiment of the present invention.

FIG. 2 is a flowchart illustrating a method 200 for synthesizing an encoded wave table for a MIDI synthesis method according to one embodiment of the present invention. The method 200 may be performed for a plurality of instruments in order to generate an encoded wave table.

First, a wave table containing uncompressed sound samples of one or more instruments and additional information having various formats is prepared in a similar manner as a conventional wave table (S210).

Next, a portion of the wave table containing a specific instrument's uncompressed sound samples is extracted (S220). The uncompressed sound samples are extracted through interpretation of the wave table, for example, by parsing.

An encoding process is then performed. During the encoding process, the extracted uncompressed sound samples corresponding to the specific instrument are compressed using an audio compression method (S230). Preferably, an encoding method appropriate for the specific instrument's characteristics is selectively used. Since the sample encoding process does not require real-time processing, an encoding method for obtaining high quality with a small data rate and great encoding complexity may be used.

After the encoding process is performed, compressed audio sample codes for the specific instrument and additional information, such as various coding parameters are generated in the form of bit streams (S240). The encoding process stores the encoded bit streams together with additional information required for encoding the samples.

Figure 3:
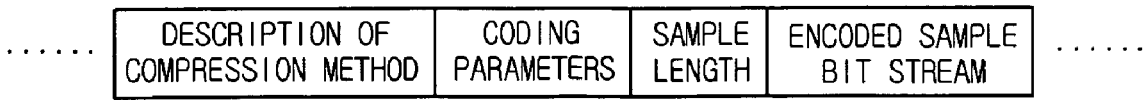
FIG. 3 illustrates a structure of an encoded sample bit stream including an encoded sample code according to one embodiment of the present invention.

FIG. 3 illustrates a typical structure of encoded sample bit streams according to one embodiment of the present invention. The bit streams include additional information and an encoded sample bit stream. The additional information may include data required for decoding the encoded sample bit stream and synthesizing a MIDI, such as coding parameters and a sample length. Further, the additional information may include information regarding the type of compression method used for the particular encoded bit stream if multiple compression formats are used in the encoding process.

The generated bit streams are stored in the wave table by replacing the specific instrument's uncompressed sound samples. In this way, the wave table is converted into an encoded wave table (S250).

The process of generating the encoded wave table includes storing the bit streams generated by the encoding process in the wave table. In contrast, a conventional wave table contains only uncompressed sound samples.

Figure 4:
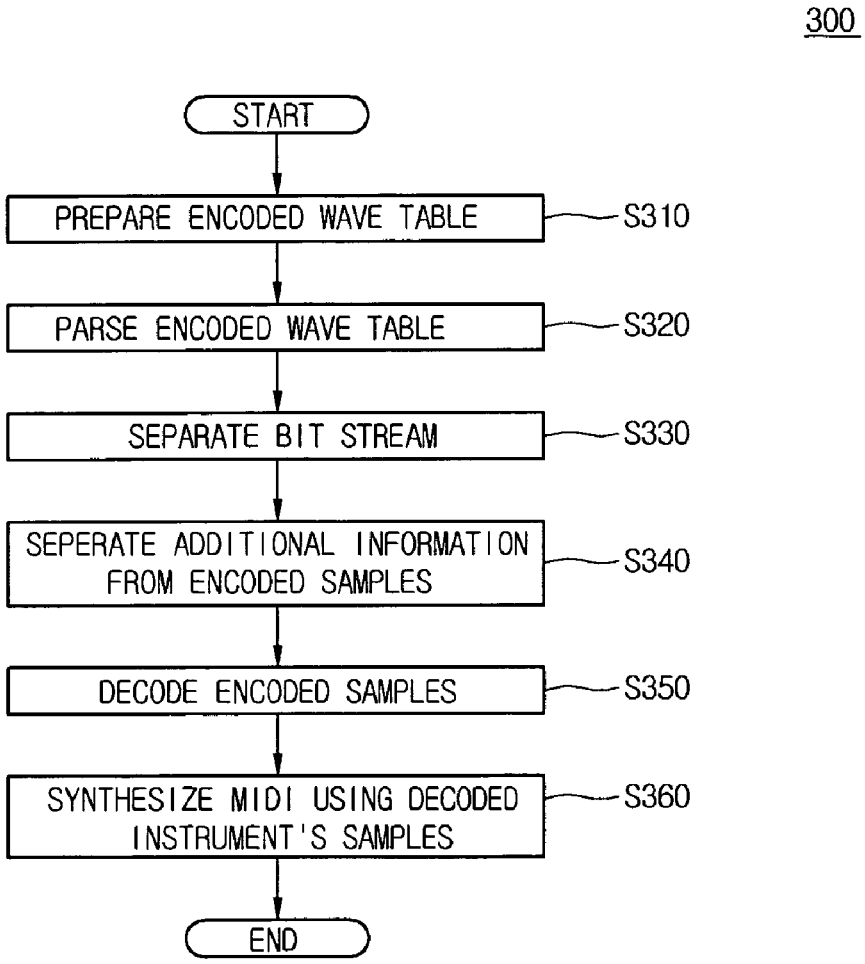
FIG. 4 is a flowchart illustrating a method for synthesizing a MIDI using the encoded wave table of FIG. 2.

FIG. 4 illustrates a flowchart a method 300 of the present invention for synthesizing a MIDI using the encoded wave table of FIG. 2. The method 300 includes decoding a specific instrument's encoded sound samples extracted from an encoded wave table and synthesizing a sound using the decoded samples.

Referring to FIG. 4, a MIDI synthesis of the present invention uses the encoded wave table containing the specific instrument's encoded sound samples (S310). Preferably, the encoded wave table is generated by the method 200 of the present invention.

The wave table is parsed to extract a portion containing the specific instrument's encoded sound samples (S320) and the bit streams containing the specific instrument's encoded sound samples are separated from the extracted portion (S330).

Next, the additional information, such as the coding parameters, is separated from the encoded sound samples (S340), the decoder decodes the encoded sound samples using the additional information (S350), and a MIDI synthesis is performed using the decoded sound samples (S360). The process of synthesizing the MIDI may use a conventional wave table type method for synthesizing a MIDI.

According to the method of the present invention for synthesizing a MIDI using an encoded wave table, the encoded wave table contains encoded bit streams instead of uncompressed samples and the bit streams are parsed and decoded to generate a specific instrument's sound samples for use in synthesizing the MIDI.

If various compression methods are used in the sample encoding process, the additional information may contain information regarding the type of compression methods that were used, as illustrated in FIG. 3. In this case, decoding is performed using the coding parameters of the relevant compression method so that an instrument's sound samples are properly decoded.

As described above, according to the present invention, an encoded wave table is generated by compressing each instrument's uncompressed sound samples stored in the wave table. Further, each instrument's sound samples are obtained by decoding the encoded bit streams when the instrument's sound samples are requested and MIDI synthesis is performed. Using the apparatus and method of the present invention, a MIDI having excellent quality may be synthesized using limited storage space.

It will be apparent to those skilled in the art that various modifications and variations can be made in the present invention. Thus, it is intended that the present invention covers the modifications and variations of this invention provided they come within the scope of the appended claims and their equivalents.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. An apparatus for synthesizing a MIDI (musical instrument digital interface), comprising:

a wave table adapted to store both uncompressed sound samples and compressed sound samples and additional information, the additional information related to the compressed sound samples;

a first parser adapted to extract a portion of uncompressed sound samples from the wave table, the extracted portion of the uncompressed sound samples corresponding to a specific instrument; and an encoder adapted to compress the extracted portion of the uncompressed sound samples to generate the compressed sound samples and the additional information.

2. The apparatus of claim 1, wherein the encoder is further adapted to compress the extracted portion of the uncompressed sound samples using one of a plurality of formats and the wave table is further adapted to store sound samples compressed using the plurality of formats.

3. The apparatus of claim 2, wherein the encoder is further adapted to selectively encode the extracted portion of the uncompressed sound samples using an encoding method corresponding to the characteristics of sound samples from the specific instrument.

4. The apparatus of claim 1, wherein the compressed sound samples and additional information generated by the encoder for each of a plurality of instruments are substituted for the corresponding uncompressed sound samples in the wave table such that the wave table contains only compressed information.

5. The apparatus of claim 1, wherein the encoder is further adapted to encode the extracted portion of the uncompressed sound samples using an encoding method that obtains high quality with a small data rate and great encoding complexity.

6. The apparatus of claim 1, wherein the additional information comprises at least one of coding parameters, sample length, or an indication of a compression format used.

7. The apparatus of claim 1, further comprising:

a second parser adapted to extract a portion of the compressed sound samples and the additional information from the wave table, the extracted portion of the compressed sound samples and the additional information corresponding to a requested instrument;

a decoder adapted to decode the extracted portion of the compressed sound samples to generate decoded sound samples; and a MIDI synthesizer adapted to perform a MIDI synthesis using the decoded sound samples.

8. The apparatus of claim 7, wherein the second parser is further adapted to separate the additional information from the extracted portion of the compressed sound samples and the decoder is further adapted to utilize the additional information to decode the extracted portion of the compressed sound samples.

9. The apparatus of claim 8, wherein the additional information comprises at least one of coding parameters, sample length, or an indication of a compression format used.

10. A method for synthesizing a MIDI (musical instrument digital interface), the method comprising:

compressing and storing sound samples for at least one instrument in a wave table; and decoding the stored compressed sound samples to synthesize the MIDI when the at least one instrument is requested, wherein both uncompressed sound samples and the compressed sound samples are stored in the wave table.

11. The method of claim 10, wherein compressing and storing the sound samples comprises:

extracting a portion of the uncompressed sound samples from the wave table, the extracted portion of the uncompressed sound samples corresponding to a specific instrument;

compressing the extracted portion of the uncompressed sound samples to generate the compressed sound samples and additional information, the additional information related to the compressed sound samples; and storing the compressed sound samples and the additional information in the wave table such that the compressed sound samples and the additional information replace the extracted portion of the uncompressed sound samples.

12. The apparatus of claim 11, further comprising:

extracting uncompressed sound samples corresponding to each of a plurality of instruments from the wave table;

compressing the extracted uncompressed sound samples corresponding to each of the plurality of instruments to generate compressed sound samples and additional information corresponding to each of the plurality of instruments; and replacing the uncompressed sound samples corresponding to each of the plurality of instruments with the corresponding compressed sound samples and additional information corresponding to each of the plurality of instruments such that the wave table contains only compressed information.

13. The method of claim 12, wherein extracting, compressing and replacing are not real-time processes and are performed prior to decoding the stored compressed sound samples to synthesize the MIDI.

14. The method of claim 11, wherein the additional information comprises at least one of coding parameters, sample length, or an indication of a compression format used.

15. The method of claim 11, wherein compressing the extracted portion of the uncompressed sound samples comprises using an encoding method that obtains high quality with a small data rate and great encoding complexity.

16. The apparatus of claim 11, wherein compressing the extracted portion of the uncompressed sound samples comprises using one of a plurality of formats.

17. The apparatus of claim 16, wherein compressing the extracted portion of the uncompressed sound samples comprises selectively performing an encoding method corresponding to the characteristics of sound samples from the specific instrument.

18. The method of claim 10, wherein decoding the stored compressed sound samples comprises:

extracting a portion of the compressed sound samples and additional information from the wave table, the extracted portion of the compressed sound samples and additional information corresponding to the requested at least one instrument;

separating the additional information from the extracted portion of the compressed sound samples;

decoding the extracted portion of the compressed sound samples to generate decoded sound samples, the decoding performed using the additional information; and synthesizing the MIDI using the decoded sound samples.

19. The method of claim 18, wherein the additional information comprises at least one of coding parameters, sample length, and an indication of a compression format used.

20. A method for synthesizing a MIDI (musical instrument digital interface), the method comprising:

extracting a portion of uncompressed sound samples from a wave table, the extracted portion of the uncompressed sound samples corresponding to a specific instrument;

compressing the extracted portion of the uncompressed sound samples to generate compressed sound samples and additional information, the additional information related to the compressed sound samples;

storing the compressed sound samples and the additional information in the wave table such that the compressed sound samples and the additional information replace the extracted portion of the uncompressed sound samples; and decoding the stored compressed sound samples to synthesize the MIDI.

* * * * *